United States Patent [19]

Gohlke

[11] Patent Number: 4,774,408

[45] Date of Patent: Sep. 27, 1988

[54] TIME OF FLIGHT MASS SPECTROMETER

[75] Inventor: Roland S. Gohlke, Webster, N.Y.

[73] Assignee: Eastman Kodak Company, Rochester, N.Y.

[21] Appl. No.: 31,297

[22] Filed: Mar. 27, 1987

[51] Int. Cl.[4] ..... H01J 49/40

[52] U.S. Cl. ..... 250/287; 250/294; 250/298; 250/396 R

[58] Field of Search ..... 250/294, 287, 396 R, 250/298

[56] References Cited

U.S. PATENT DOCUMENTS 3,061,720 10/1962 Ewald ..... 250/294
3,863,068 1/1975 Poschenrieder ..... 250/287

FOREIGN PATENT DOCUMENTS 2620877 11/1977 Fed. Rep. of Germany ..... 250/294

OTHER PUBLICATIONS

Poschenrieder, "Multiple-Focusing Time of Flight Mass Spectrometers Part I. TOFMS with Equal Momentum Acceleration", *International Journal of Mass Spectrometry and Ion Physics,* vol. 6, 1971, pp. 413–426.
Poschenrieder, "Multiple-Focusing Time of Flight Mass Spectrometers Part II. TOFMS with Equal Energy Acceleration", *International Journal of Mass Spectrometry and Ion Physics,* vol. 9, 1972, pp. 357–373.
Sakurai et al, "Ion Optics for Time-of-Flight Mass Spectrometers with Multiple Symmetry", *International Journal of Mass Spectrometry and Ion Processes,* vol. 63, 1985, pp. 273–287.
Sakurai et al, "A New Time-of-Flight Mass Spectrometer", *International Journal of Mass Spectrometry and Ion Processes,* vol. 66, 1985, pp. 283–290.
Sakurai et al, "Particle Flight Times in a Toroidal Condenser and an Electric Quadrupole Lens in the Third Order Approximation", *International Journal of Mass Spectrometry and Ion Processes,* vol. 68, 1986, pp. 127–154.

*Primary Examiner*—Carolyn E. Fields
*Assistant Examiner*—John A. Miller
*Attorney, Agent, or Firm*—Carl O. Thomas

[57] ABSTRACT

A time of flight mass spectrometer is disclosed comprised of a deflection field for ion parcels including at least one pair of inner and outer electrodes. The inner and outer electrodes present ion guiding surfaces which in planes normal to the ion flight path are convex and concave, respectively, and more closely spaced at their edges than at any mediate location.

8 Claims, 5 Drawing Sheets

TIME OF FLIGHT MASS SPECTROMETER

FIELD OF THE INVENTION

This invention is directed to time of flight mass spectrometers. It relates more particularly to time of flight mass spectrometers which contain at least one deflection field.

BACKGROUND OF THE INVENTION

Time of flight (TOF) mass spectrometers have developed into well established analytical instruments for identifying materials based on a distribution (spectrum) of charged particles differing in mass created by pulsed radiant energy or particle bombardment. A sample of material whose spectrum is sought is mounted as a target in an electric field. Bombardment with accelerated particles, such as perfect gas atoms or ions, or high intensity electromagnetic radiation, disrupts the molecules of the target to create a variety of charged particles—e.g., molecular ions, fragments, cations, and/or anions—hereinafter collectively referred to as ions. Once an ion of the sample material is created, it is accelerated in the electric field toward an electrode of opposite charge. A portion of accelerated ions is allowed to pass through an aperture in the attracting electrode and embark on a flight path which, through creation of an ambient vacuum, can be of extended length.

When the target sample receives a bombardment pulse, parcels of ions of like polarity but differing in mass are generated. Given that each ion creating collision imparts the same momentum $$mv$$

where m is mass and v is velocity, it follows that ions of greater mass have a lower velocity. Since velocity is $$d/t$$

where d is distance and t is time, it follows that ions differing in mass within any single parcel will arrive at different times at a reference location along their common flight path. Stated another way, the original parcel of ions created by the bombardment pulse divides itself into partial parcels consisting of ions of the same mass and differing in mass from the ions of other partial parcels. By measuring and comparing the time of flight of partial parcels a spectrum of flight times can be identified which can them be mathematically translated into a mass spectrum unique to the sample material.

If all the ions in each partial parcel entered the flight path with exactly the same initial energy, then very compact (highly focused) partial parcels each consisting of ions of identical mass would be created. In practice there is a range of kinetic energies initially imparted to the ions within a partial parcel and this can lead to a range of flight times of ions within any given partial parcel that is broad enough to overlap flight time ranges of adjacent partial parcels.

The solution to this problem has been to provide a focusing deflection field in the flight path. The deflection field causes the partial parcels to traverse one or more arcs. In so doing, within each partial parcel the ions of higher kinetic energies in undergoing the same angular deflection traverse arcs of longer radii than ions of lower kinetic energies. Thus, the time required for ions of differing kinetic energies within each partial parcel to traverse the deflection field is evened out by the unequal arc paths. By locating the deflection field between time measurement reference locations in the flight path, usually referred to as entrance and exit planes, the result is to focus the partial parcels. Stated another way, the function of the deflection field is to make the flight time of ions in each partial parcel a function of the ratio of ion mass (m) to charge (e) rather than initial differences in kinetic energies.

A schematic diagram of a conventional time of flight mass spectrometer containing a deflection field is shown in FIG. 1. The mass spectrometer 100 is comprised of a central vacuum chamber 102 defining an ion flight path indicated by arrows 104 extending between an entrance plane 106 and an exit plane 108. The ambient pressure in the vacuum chamber is maintained below $1.33\times10^{-4}$ kilopascals ($<10^{-5}$ torr) to minimize ion collisions with the ambient atmosphere. There is located in the vacuum chamber between the dashed lines 110 and 112 a deflection field zone 114. The deflection field as shown is a preferred quadruple focusing deflection field, more specifically described below, but the deflection field in its simplest form can deflect the ions in their flight path through a single arc. A pulsed ion source 116 emits a parcel of accelerated ions across the entrance plane into the flight path within the vacuum chamber. The ion source is also internally evacuated and can therefore be viewed as an extension of the flight path vacuum chamber. Beyond the exit plane there is located a receiving unit 118 for the ions traveling along the flight path. The receiving unit forms a second extension of the ion flight path vacuum chamber. By referencing the time at which receipt of a partial parcel is detected to the time a target pulse was generated in the ion source, a measurement of the time elapsed in traversing the flight path vacuum chamber between its entrance and exit planes can be provided.

The Problems to be Overcome

The problems which the present invention specifically address are the loss of ions from the flight path in the deflection field and the inability of conventionally constructed deflection fields to bring the ions back into focus.

To appreciate the problems and the novel solutions provided by this invention it is necessary to review the construction of conventional deflection fields. Deflection fields are formed by one or more pairs (usually four pairs) of spaced inner and outer electrodes. A typical electrode pair arrangement is shown in FIG. 2. The inner electrode 201 provides an ion guiding surface 203 which is cylindrical in shape over an arc of approximately 270°. This inner ion guiding surface has a radius $R^1$. Spaced from the inner electrode is an outer electrode 205 providing an outer ion guiding surface 207 which is cylindrical in shape over the same approximately 270° arc. The outer ion guiding surface has a radius $R^2$. Both radii $R^1$ and $R^2$ have a common origin C.

In operation, ions traveling along a linear flight path L enter the space S between the inner and outer electrodes. The ions in the flight path all exhibit the same charge polarity. In addition they exhibit a range of kinetic energies above and below an average value. The inner and outer electrodes are electrically biased to exhibit the same polarity as the ions. The voltage applied to the outer electrode is higher than that applied to the inner electrode. The voltages can be selected by known relationships to allow ions of average kinetic energy to traverse the arc defined by the spaced electrodes along a flight path mid-way between the opposed inner and outer ion guiding surfaces. The ions are deflected and guided by charge repulsion. Ions of slightly higher than average kinetic energies must approach the outer ion guiding surface somewhat more closely to be repelled and therefore traverse an arc of a slightly longer than average radius. Conversely, ions of slightly lower than average kinetic energies are repelled from the outer electrode ion guiding surface more readily and traverse an arc having a somewhat shorter than average radius.

Since in FIGS. 1 and 2 only the main ion flight paths are schematically illustrated, it must be borne in mind that in practice some ions, from the time they pass through the aperture in the accelerating electrode, diverge from the desired flight path. This is best illustrated by FIG. 3, which is a schematic sectional view taken along the flight path L. The radial vectors V schematically represent (on an exaggerated scale) the radial components of the flight of individual ions. When the vectors V are combined with the flight vectors along the flight path L, it can be appreciated that the ions in flight lie within a cone of scatter of which the flight path L is the idealized embodiment when V is zero.

To the extent that ions diverge from the ideal flight path L they can fail to reach the partial parcel detector. This results in signal strength reduction, thereby increasing the demands that must be placed on both the source and detection means to compensate for this loss.

As shown in FIG. 4, when the ions are traveling between the ion guiding surfaces of the inner and outer electrodes, ion divergence is partially repressed by the field gradient between the electrodes. However, when the radial vector of flight of a ion lies in a plane of uniform potential—i.e., any vertical plane, divergence of the ion is not overcome, as schematically indicated by vectors $V^1$ and $V^2$. From FIG. 4 it is apparent that the cylindrical ion guiding surfaces can repress lateral divergence of the ions from their ideal flight path, thereby spatially focusing the ions in one spatial dimension, but are ineffective to achieve complete focusing of the ions in the ideal flight path L.

A modified construction of deflection field electrodes that has been described in the art is shown in FIGS. 5 and 6. Field plates 209 and 211 are mounted above and below the inner and outer electrodes. The field plates are also electrically biased to repel the ions, but since they are maintained at a potential different from both that of the inner and outer electrodes, they are spaced from both electrodes. Further, since the inner and outer electrodes are themselves at differing potentials, the field plates must be spaced to avoid shorting these electrodes.

The deficiencies of the field plates is schematically shown in FIG. 6, which is a section taken along section lines 6—6 i FIG. 2. Ions which diverge from flight path L along flight paths $L^1$ and $L^2$ which include the vectors $V^1$ and $V^2$, respectively, as components, are repelled by the field plates 209 and 211, but are not returned to the flight path L. Instead they are free to escape from the deflection field through the spacing between the field plates and and the outer electrode. Thus, the addition of field plates does not overcome the problem of loss of ions from the flight path.

Prior Art

The following are illustrative of the prior state of the art:

R-1 Poschenrieder, "Multiple-Focusing Time of Flight Mass Spectrometers Part I. TOFMS With Equal Momentum Acceleration", *International Journal of Mass Spectrometry and Ion Physics,* Vol. 6, 1971, pp. 413–426.

R-2 Poschenrieder, "Multiple-Focusing Time of Flight Mass Spectrometers Part II. TOFMS With Equal Energy Acceleration", *International Journal of Mass Spectrometry and Ion Physics,* Vol. 9, 1972, pp. 357–373.

R-3 Poschenrieder U.S. Pat. No. 3,863,068, issued Jan. 28, 1975.

R-4 Sakurai et al, "Ion Optics for Time-of-Flight Mass Spectrometers with Multiple Symmetry", *International Journal of Mass Spectrometry and Ion Processes,* Vol. 63, 1985, pp. 273–287.

R-5 Sakurai et al, "A New Time-of-Flight Mass Spectrometer", *International Journal of Mass Spectrometry and Ion Processes,* Vol. 66, 1985, pp. 283–290.

R-6 Sakurai et al, "Particle Flight Times in a Toroidal Condenser and an Electric Quadrupole Lens in the Third Order Approximation", *International Journal of Mass Spectrometry and Ion Processes,* Vol. 68, 1986, pp. 127–154.

SUMMARY OF THE INVENTION

In one aspect this invention is directed to a time of flight mass spectrometer comprised of (i) means including an entrance plane and an exit plane defining an ion flight path in which parcels of ions divide into partial parcels of equal effective mass, (ii) a pulsed ion source which emits a parcel of accelerated ions across the entrance plane into the flight path, and (iii) means for detecting the partial parcels of ions beyond the exit plane and recording their elapsed time of flight between the entrance and exit planes. The flight path defining means includes means defining a deflection field for the ion parcels including at least one pair of inner and outer electrodes, the inner and outer electrodes presenting spaced inner and outer ion guiding surfaces each curved in the direction of ion flight.

The invention is characterized in that, in planes normal to the ion flight path, the inner electrode ion guiding surface is convex, the outer electrode ion guiding surface is concave, and the ion guiding surfaces of the inner and outer electrodes are more closely spaced at their opposed edges than mediate their edges.

The time of flight mass spectrometers of this invention exhibit advantages not realized with conventional TOF mass spectrometers. One of the foremost advantages is that of signal enhancement. A larger proportion of the ions set in motion along the flight path reach the partial parcel detector. Additionally, the partial parcels which reach the detector are more compactly focused. The problems of conventional TOF mass spectrometers discussed above are therefore overcome.

BRIEF DESCRIPTION OF THE DRAWINGS

Other advantages of the TOF mass spectrometers of the invention can be more fully appreciated by reference to the following detailed description considered in conjunction with the drawings, wherein.

DESCRIPTION OF PREFERRED EMBODIMENTS

The TOF mass spectrometers of the present invention are improved over those of the prior art in employing in the deflection field portion of the apparatus at least one pair of inner and outer electrodes having spaced opposed ion guiding surfaces which are curved in planes normal to the ion flight path. Specifically, the inner electrode presents an ion guiding surface which is convex in planes normal to the ion flight path while the outer electrode presents an ion guiding surface which is concave in planes normal to the ion flight path. In addition, in planes normal to the ion flight path, the inner and outer electrode ion guiding surfaces are more closely spaced at their edges than mediate their edges.

Figure 7:
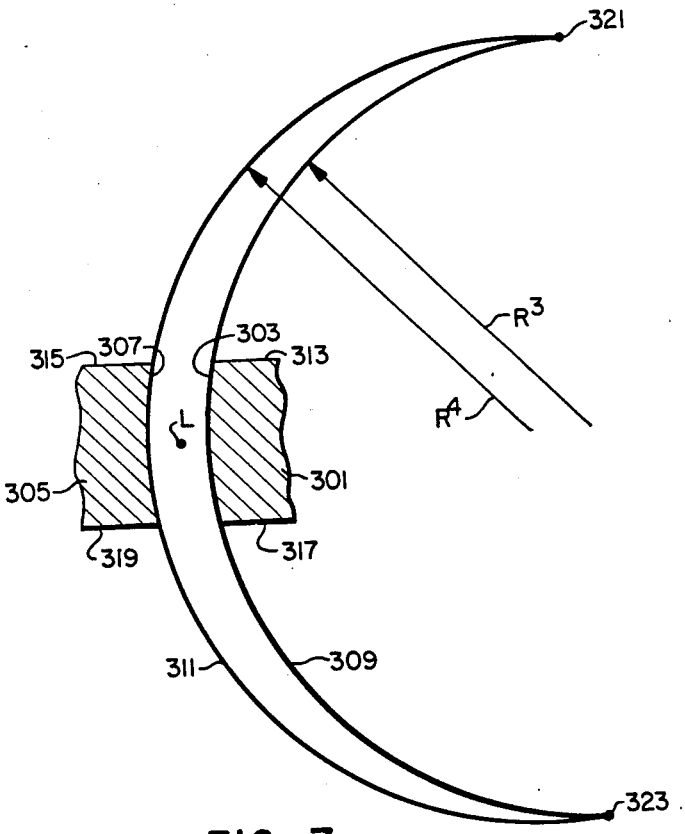
FIG. 7 is a schematic sectional detail taken along a plane normal to the ion flight path (i.e., sectionally oriented similarly as FIGS. 4 and 5) of inner and outer electrodes with ion guiding surfaces satisfying the requirements of the invention.

A preferred embodiment of inner and outer electrodes satisfying the ion guiding surface configuration of the invention is shown in FIG. 7. Inner electrode 301 is shown providing an inner ion guiding surface 303 while spaced outer electrode 305 is shown providing an outer ion guiding surface 307. In the specific form shown the inner ion guiding surface is defined by the perimeter of a sphere 309 partially shown in section having a radius $R^3$. The outer ion guiding surface of the outer electrode is defined by the perimeter of an ellipsoid in this instance as oblate sphere 311 partially shown in section. The minor radius of curvature $R^4$ of the ellipsoid or oblate sphere is equal to the radius of curvature of the sphere. Although not easily observed by casual inspection, the opposed upper edges 313 and 315 of the inner and outer electrodes as well as the opposed lower edges 317 and 319 of the these electrodes are closer together than other portions of the inner and outer ion guiding surfaces. This can be visually confirmed merely by noting that the surfaces of the sphere and oblate sphere merge at their upper extremity 321, diverge smoothly until reaching the level of the ideal ion flight path L equally spaced from the upper and lower edges of the inner and outer electrodes, and then converge smoothly toward their common lower extremity 323.

Figure 4:
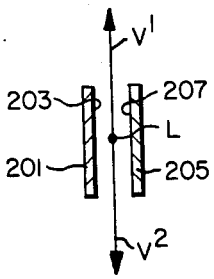
FIG. 4 is a section taken along section line 4—4 (lying in a plane normal to the ion flight path) in FIG. 2.
Figure 5:
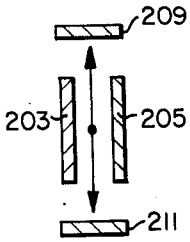
FIG. 5 is a section similar to FIG. 4, but differing by the addition of field plates.
Figure 6:
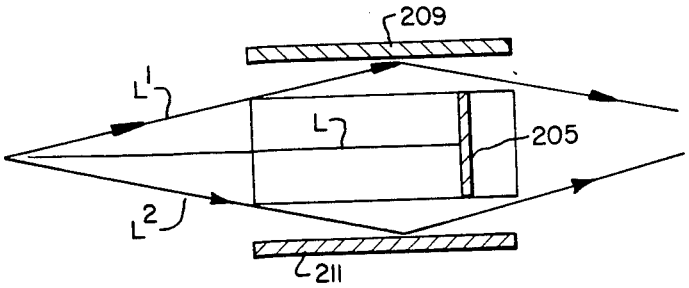
FIG. 6 is a section taken along section line 6—6 in FIG. 2 and showing the presence of field plates.

The manner in which the curvature of the ion guiding surfaces prevents straying and loss of ions can be appreciated by comparing FIGS. 4 and 7. Using conventional cylindrical ion guiding surfaces, there are an infinite number of vertical planes of uniform potential separating these concentric parallel cylindrical surfaces. Any ion following a flight path including a vertical radial vector is not deterred by the cylindrical surfaces and can therefore escape from the deflection field. However, viewing FIG. 7, it is apparent that the curved shape of the opposed ion surfaces precludes any plane of uniform potential being present between the electrodes. To graphically illustrate this, it is apparent that in FIG. 7 no radial vector lying in a plane of equal potential can be drawn emanating from flight path L (or any other selected point in the space between the ion guiding surfaces). Further, the higher field gradients produced by the reduced spacings of the upper and lower edges of the ion guiding surfaces constitute potential barriers to escape of ions from the deflection field. ion containment by the ion guiding surfaces can be illustrated by considering an ion at point L having a vertical radial vector of flight. As the vertical component of flight seeks to move the ion either up or down from the point L, a higher repelling force from the outer electrode is encountered which acts to deflect the ion back toward its initial central location.

In the embodiment of FIG. 7 inner ion guiding surface has a radius of curvature $R^3$ which is equal to the radius of curvature $R^4$ of the outer ion guiding surface. The desired reduced edge spacing of the ion guiding surfaces can be realized so long as the radius of curvature $R^3$ is equal to or greater than the radius of curvature $R^4$. As described above the inner ion guiding surface conforms to the periphery of a sphere while the outer ion guiding surface conforms to the periphery of an oblate sphere, where $R^4$ is the minor radius of the oblate sphere. An alternative relationship is for the outer ion guiding surface to be a spherical section with the inner ion guiding surface being formed by the major radius of an ellipsoid or oblate sphere. Further, neither spherical nor ellipsoidal surface geometries are required. So long as the edge spacing relationship is satisfied any other convenient curved ion guiding surface configuration can be employed. For example, such surface can be generated by the rotation of a parabola, catenary, or other conveniently mathematically generated curve about an axis.

Figure 1:
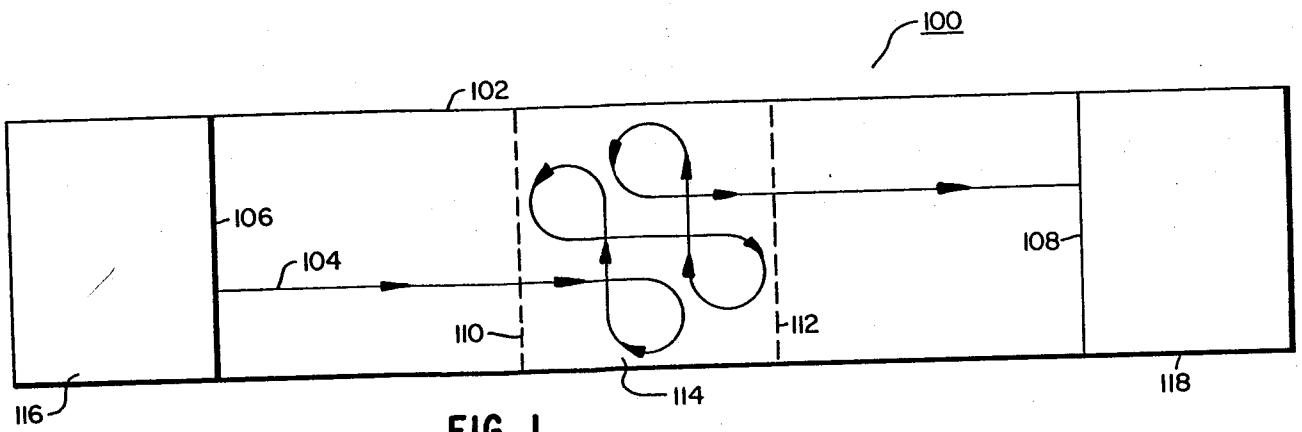
FIG. 1 is a schematic diagram showing features common to conventional TOF mass spectrometers and those of the present invention.
Figure 2:
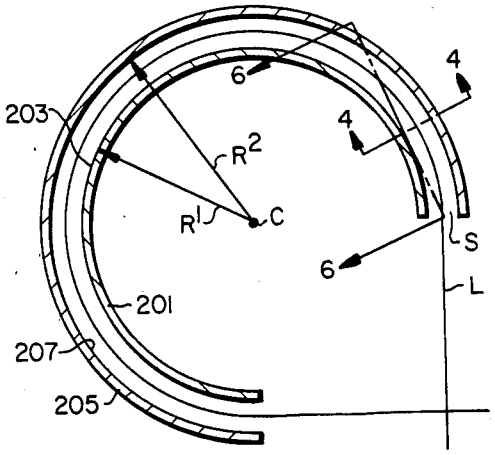
FIG. 2 is a sectional view of a conventional deflection field electrode pair.
Figure 3:
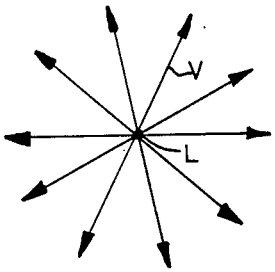
FIG. 3 is a schematic vector diagram of ion directions of travel as viewed along section line 3—3 in FIG. 2.
Figure 8:
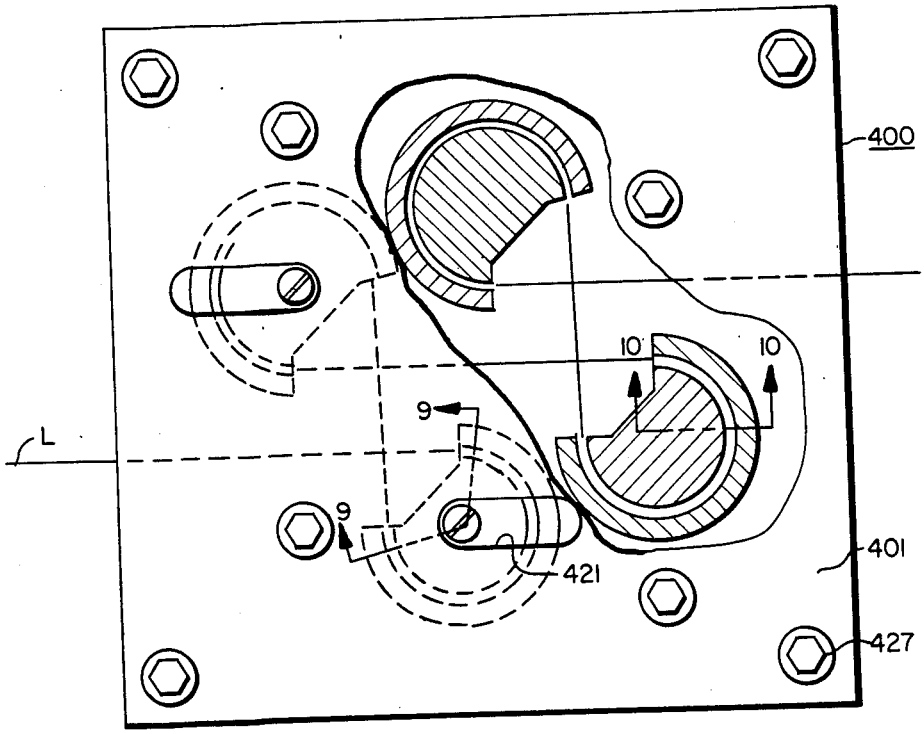
FIG. 8 is a plan view, partly in section, showing a preferred deflection field apparatus satisfying the requirements of the invention.
Figure 9:
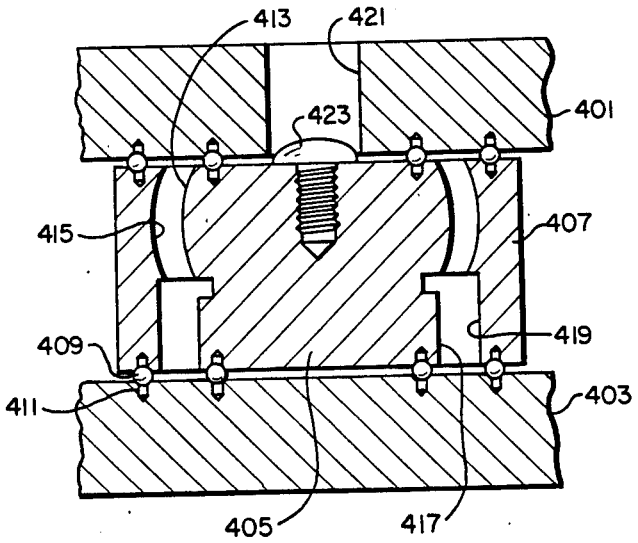
FIG. 9 is a section taken along section line 9—9 in FIG. 8.
Figure 10:
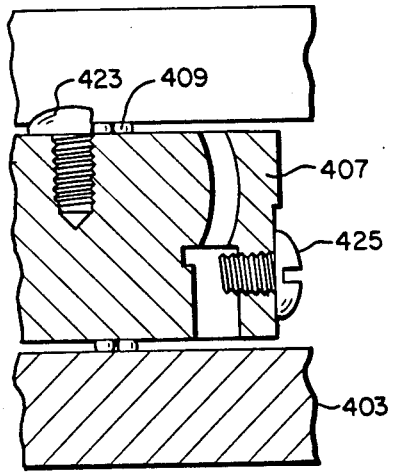
FIG. 10 is a section taken along section line 10—10 in FIG. 8.

FIGS. 8 through 10 illustrate a preferred deflection field unit 400 according to the present invention. Between a pair of mounting plates 401 and 403 are mounted four identical pairs of inner and outer electrodes forming a quadruple arc deflection field. Four deflection arcs are required to bring the partial parcels of ions exiting into focus spatially (in the three mutually perpendicular planes of space, usually referred to as X, Y, and Z planes), and in terms of elapsed time of flight (t), momentum (mv), and kinetic energy ($0.5\ mv^2$). The overall line of flight through the deflection field unit is similar to that shown in the deflection zone 114 of FIG. 1, except that in this unit dissipation of ions through misdirection is reduced.

Referring to FIG. 9, an inner electrode 405 and an outer electrode 407 are shown electrically isolated from the mounting plates by being supported on insulative beads 409 seated in aligned recesses 411 in the mounting plates and electrodes. The inner electrode provides an inner ion guiding surface 413 while the outer electrode provides an outer ion guiding surface 415. The inner and outer ion guiding surfaces converge toward their upper and lower edges, as previously described above with reference to FIG. 7.

Below its ion guiding surface the inner electrode is provided with a mounting spindle 417 which can be of any convenient shape. The outer electrode below its ion guiding surface is internally recessed at 419 to increase its spacing from the inner electrode.

The upper mounting plate 401 is provided with slots 421 over each inner electrode to permit access to a lead attachment screws 423 threaded into the inner electrodes. A lead mounting screw 425 is threaded into each outer electrode. Bolts 427 are employed to compress the mounting plates against the electrodes, thereby holding the electrodes in their desired spatial arrangement.

The portions of the inner and outer electrodes below their ion guiding surfaces are more conveniences of construction and are not required. If desired, the ion guiding surfaces can extend from the top of the bottom of both the inner and outer electrodes. The mounting plates in the preferred deflection field unit are grounded. The mounting plates, being electrically isolated from both electrodes could, if desired, be biased to serve as field plates, but this is not required, since the curvature of the ion guiding surfaces can be entirely relied upon to prevent ion escape from the deflection fields. The use of mounting plates to locate the electrodes in position is not required, since the availability of alternative mounting arrangements can be readily appreciated.

Although a quadruple arc deflection field unit containing four identical pairs of electrodes satisfying the requirement of this invention has been described, it is appreciated that in its simplest form a deflection unit according to the present invention can include only a single pair of inner and outer electrodes having ion guiding surfaces satisfying the curvature requirements described above. This electrode pair can be used alone or in combination with conventional deflection field electrode pairs. However, to maximize the advantages of this invention, the use of four pairs of electrodes satisfying the ion guiding surface requirements of this invention to form a deflection field unit are preferred.

The invention has been described in detail with particular reference to preferred embodiments thereof, but it will be understood that variations and modifications can be effected within the spirit and scope of the invention.

What is claimed is:

1. A time of flight mass spectrometer comprised of means including an entrance plane and an exit plane defining an ion flight path in which parcels of ions divide into partial parcels of equal effective mass, a pulsed ion source which emits a parcel of accelerated ions across said entrance plane into the flight path, and means for detecting the partial parcels of ions beyond said exit plane and recording their elapsed time of flight between said entrance and exit planes, said flight path defining means including means defining a deflection field for the ion parcels including at least one pair of inner and outer electrodes, said inner and outer electrodes presenting spaced inner and outer ion guiding surfaces each curved in the direction of ion flight, characterized in that, in planes normal to the flight path, said inner electrode ion guiding surface is convex, said outer electrode ion guiding surface is concave, and said ion guiding surfaces of said inner and outer electrodes have the same radius of curvature and are more closely spaced at their opposed edges than at any mediate location.

2. A time of flight mass spectrometer according to claim 1 wherein said deflection field defining means includes a plurality of pairs of spaced inner and outer electrodes.

3. A time of flight mass spectrometer according to claim 2 wherein said deflection field defining means includes four pairs of spaced inner and outer electrodes.

4. A time of flight mass spectrometer according to claim 3 wherein each of said electrode pairs presents an ion guiding surface which extends over an arc of approximately 270° in the direction of the ion flight path.

5. A time of flight mass spectrometer according to claim 1 wherein plates lying parallel to the plane of ion flight are located adjacent and spaced from the edges of the ion guiding surfaces.

6. A time of flight mass spectrometer according to claim 5 wherein four pairs of inner and outer electrodes are located between said plates.

7. A time of flight mass spectrometer according to claim 6 including insulative means interposed between said electrodes and said plates.

8. A time of flight mass spectrometer according to claim 7 including means for electrically biasing said inner and outer electrodes to differing potentials of the same polarity as that of the ions forming the flight path.

* * * * *